US009291176B2

(12) United States Patent
Voiculescu et al.

(10) Patent No.: US 9,291,176 B2
(45) Date of Patent: Mar. 22, 2016

(54) LOCKING MECHANISM FOR LOCKING AN ACTUATOR

(71) Applicant: Messier-Dowty Inc., Ajax (CA)

(72) Inventors: Dan Amariei Voiculescu, Maple (CA); Ernest Leung, North York (CA)

(73) Assignee: Messier-Dowty Inc., Ajax (CA)

( * ) Notice: Subject to any disclaimer, the term of this patent is extended or adjusted under 35 U.S.C. 154(b) by 517 days.

(21) Appl. No.: 13/753,619

(22) Filed: Jan. 30, 2013

(65) Prior Publication Data

US 2014/0208935 A1 Jul. 31, 2014

(51) Int. Cl.
*F15B 15/26* (2006.01)

(52) U.S. Cl.
CPC ..... *F15B 15/261* (2013.01)

(58) Field of Classification Search
CPC ..... F15B 15/261
USPC ..... 91/41, 43, 44, 45; 92/23, 26, 27, 28
See application file for complete search history.

(56) References Cited

U.S. PATENT DOCUMENTS

| | | | | |
|---|---|---|---|---|
| 2,130,618 | A * | 9/1938 | Gnavi | 91/44 |
| 3,889,576 | A * | 6/1975 | Sheffer et al. | 91/394 |
| 4,248,138 | A | 2/1981 | Akkerman | |
| 4,295,413 | A | 10/1981 | Kamimura | |
| 4,854,218 | A * | 8/1989 | Stoll | 91/1 |
| 5,050,484 | A | 9/1991 | Kamimura | |
| 5,406,879 | A * | 4/1995 | Willacy | 92/24 |
| 5,427,329 | A * | 6/1995 | Renzelmann et al. | 244/49 |
| 6,598,513 | B2 * | 7/2003 | Yabe | 91/404 |
| 7,013,792 | B2 | 3/2006 | Yamaguchi | |
| 7,299,739 | B2 * | 11/2007 | Nakata et al. | 92/15 |
| 2009/0266228 | A1 * | 10/2009 | Teschke et al. | 92/24 |

OTHER PUBLICATIONS

International Search Report dated Apr. 10, 2014 issued by the Canadian Intellectual Property Office relating to PCT International Application No. PCT/CA2014/000021.

Written Opinion of the International Searching Authority dated Apr. 10, 2014 issued by the Canadian Intellectual Property Office relating to PCT International Application No. PCT/CA2014/000021.

* cited by examiner

*Primary Examiner* — Thomas E Lazo
(74) *Attorney, Agent, or Firm* — Growling Lafleur Henderson LLP

(57) ABSTRACT

A locking mechanism for locking an actuator piston within an actuator cylinder housing is disclosed. The locking mechanism comprises a locking pin that is moveable between extended and retracted positions. The locking pin can be moved using a controller, such as a hydraulic controller, for example. In the extended position the locking pin engages the actuator piston thereby locking the actuator piston in a specific position. The locking mechanism includes a mechanical bias (such as a spring or other mechanical system) that biases the locking pin towards an extended position to lock the actuator piston when counter-pressure on the locking pin is lower than the pressure provided by the mechanical bias. The locking pin can be hydraulically operated so that hydraulic pressure that forces the actuator piston to retract also exerts force on the locking pin to move it from a locked position to an unlocked position.

14 Claims, 8 Drawing Sheets

LOCKING MECHANISM FOR LOCKING AN ACTUATOR

FIELD OF THE INVENTION

The present disclosure relates to locking mechanisms for locking an actuator in a fixed position.

BACKGROUND

Actuators are commonly used to operate components of large machinery, such as aircraft. For example, linear actuators may be used to extend and retract landing gear or undercarriages of aircraft. Linear actuators may also be used in other aerospace or non-aerospace applications.

Actuators often require a locking mechanism to ensure that the actuator remains in a specific position. For example, the actuator may be required to sustain a load while remaining in a specific position. Specifically, in operating landing gear on an aircraft the actuators should be locked to ensure that the landing gear remains in the required position, sustaining all necessary landing and ground loads.

Present mechanisms for locking actuators in an extended position or for locking an actuator to sustain a load may be prohibitively expensive. These types of locking mechanisms may also have numerous parts and can be susceptible to breakage, failure and wear. Typical locking mechanisms must therefore be regularly maintained or replaced at a high cost. Present locking mechanisms rely on a hydraulic system to control the operation of the locking mechanism. This hydraulic control system for the locking mechanism is expensive to manufacture and susceptible to failure.

SUMMARY

Accordingly, there is provided a locking hydraulic actuator for locking an actuator member in an extended position, the locking actuator comprising an actuator housing for receiving the actuator member therein, the actuator housing defining an upper interior actuator chamber for receiving hydraulic fluid to exert an extension force on the actuator member, the actuator housing having a lower interior actuator chamber for receiving hydraulic fluid to exert a retraction force on the actuator member; a lock mechanism housing defining an interior cavity extending into the lower chamber of the actuator housing; and a locking pin in sealed engagement within the interior cavity of the lock mechanism housing, the locking pin mechanically biased towards a locking position wherein the locking pin extends into the lower interior actuator chamber to lockingly engage the actuator member. In some aspects the interior cavity defines an upper chamber above the sealed engagement of the locking pin and a lower chamber below the sealed engagement of the locking pin, the lower chamber configured to receive hydraulic fluid to move the locking pin to an unlocked position. In some aspects, the interior cavity defines an upper chamber above the sealed engagement of the locking pin, the upper chamber configured to receive hydraulic fluid to move the locking pin to the locking position. In still other aspects, the upper chamber can be configured to receive hydraulic fluid to move the locking pin to the locking position. In yet another aspect, the lower interior actuator chamber can be in fluid communication with the lower chamber of the interior cavity such that hydraulic fluid received in the lower interior actuator chamber exerts an unlocking force on the locking pin to move the locking pin towards the unlocked position. In some aspects, the upper interior actuator chamber is in fluid communication with the upper chamber of the interior cavity such that hydraulic fluid received in the upper interior actuator chamber exerts a locking force on the locking pin to move the locking pin to the locked position. In still yet another aspect, the locking pin can be mechanically biased towards the locking position by a spring.

In another aspects, there is provided a method for locking an actuator member in a selected position using a locking mechanism having a locking pin slideable within a housing between a locked position and a retracted position, the method comprising: adjusting the actuator member to the selected position; sliding the locking pin into the locked position; and engaging the locking pin with the actuator member for locking the actuator member in the selected position.

The locking hydraulic actuator provides a reliable form of locking a linear actuator in a specific position. The locking mechanism is a mechanical and hydraulic based locking pin design that retracts to allow actuator member retraction when hydraulic fluid pressure is introduced into the bottom of the actuator housing and the bottom of the piston style locking pin. The subsequent buildup of pressure pushes the locking pin up, compressing the spring, and allows retraction of the actuator member.

The locking hydraulic actuator provides locking of the actuator member in the extended position when hydraulic fluid is introduced at the top of the actuator housing causing the hydraulic fluid to exit the bottom of the actuator housing. When the actuator reaches the locking position the loss of hydraulic pressure allows the compressed spring to expand into its uncompressed state and push the locking pin down into the recess of the actuator member to lock the actuator in place. The actuator assembly can be locked in the extended position even if a total loss of hydraulic pressure occurs. If this occurs in an environment similar to aircraft landing gear where the weight and aerodynamic drag cause the landing gear to fall into the extended position, the locking hydraulic actuator provides a failsafe mechanical locking mechanism provided by the spring or other mechanical biasing means of the locking pin.

The locking hydraulic actuator provides at least a locking mechanism for locking an actuator that can precisely lock an actuator member in place while using a minimal number of parts and that is not complex to operate relative to existing locking mechanisms for locking actuators. The locking mechanism is relatively easy to manufacture at a relatively low cost. The reduced costs are achieved through lower manufacturing and assembly costs due to the simple nature of the design concept and reduced maintenance and overhaul costs due to the robustness, reliability, and the location of the mechanism.

The locking mechanism for the actuator is external to the actuator housing. The location of the locking mechanism means that the mechanism does not directly interfere with the internal working components of the actuator and also limits the number of components in the actuator housing.

BRIEF DESCRIPTION OF THE DRAWINGS

In order that the subject matter may be readily understood, embodiments are illustrated by way of examples in the accompanying drawings, in which.

DETAILED DESCRIPTION

Figure 1:
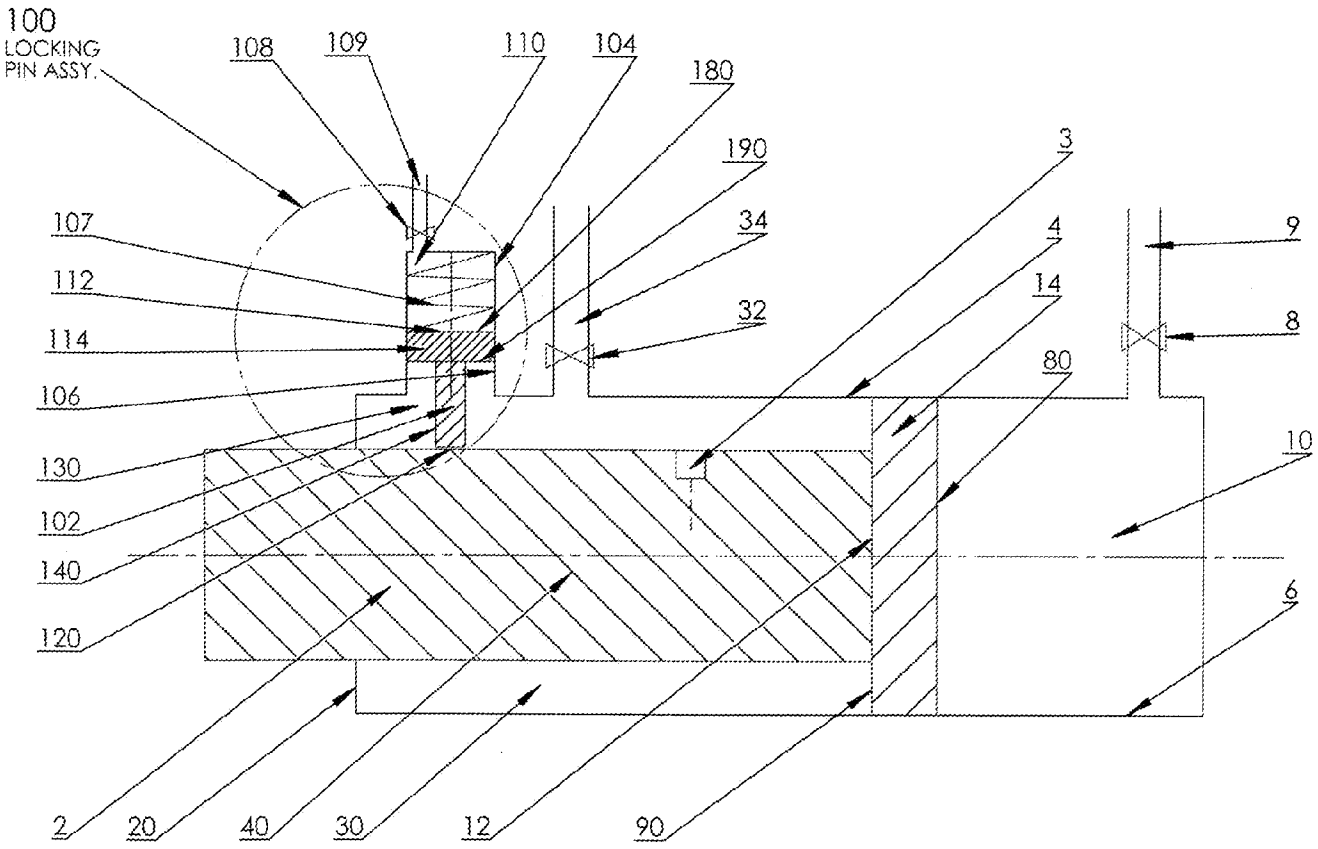
FIG. 1 is a schematic diagram of an actuator assembly with a locking pin assembly showing the actuator member in a first position.

A locking mechanism is used for locking an actuator in a specific orientation, preferably an extended position. The linear actuator has an actuator housing, such as a cylindrical housing, for example, with an actuator member, such as a piston rod, for example. The actuator member moves relative to the actuator housing to slide between an extended and retracted position. The locking mechanism comprises a piston-style locking pin that slideably engages the actuator member using a hydro-mechanical control system. The locking mechanism engages the actuator member so that when the actuator member is in the extended position the bottom end of the locking pin engages with the actuator member thereby preventing relative movement of the actuator member within the actuator housing. Specifically, the locking mechanism is mounted to the actuator housing and the locking pin is operable to extend through the actuator housing to engage with the actuator member to lock it into a predetermined locked position.

More particularly, the locking mechanism for locking an actuator member in a selected position comprises: a locking pin having a bottom end for engaging the actuator member; and a housing having an interior for slideably containing the locking pin, the locking pin slideable within the housing between an extended position and a retracted position, in the extended position the bottom end of the locking pin engages the actuator member, when the actuator member is in the selected position, and locks the actuator member in the selected position, wherein the sliding of the locking pin in the housing between the extended position and the retracted position is controlled by a controller.

In some embodiments the locking pin has a middle section, or body, defining a top end and a bottom end; the top end of the locking pin and the housing defining an upper chamber, the middle section of the locking pin and the housing defining a lower chamber; the locking mechanism further comprising a lower valve for providing a fluid passage to the lower chamber for controlling fluid flow and/or pressure to the lower chamber for enabling movement of the locking pin into the retracted position, wherein the controller is a hydraulic pump for controlling the flow and/or pressure of hydraulic fluid in the upper chamber and lower chamber.

In one embodiment, the locking mechanism further comprises a spring within the interior of the housing, the spring being engaged with the locking pin for biasing the locking pin towards the extended position.

In one embodiment, the actuator member includes a recess for receiving at least a portion of the locking pin when the actuator member is in the selected position. Alternatively, the actuator member comprises a plurality of recesses, each recess defining one of a plurality of respective selected positions for receiving the piston. In some embodiments, the recess can be circumferential.

In one embodiment, the locking pin housing is independent from the actuator housing. In a further embodiment, in the retracted position, the locking pin is fully enclosed in the housing.

In a further embodiment, the actuator member is controlled using hydraulic fluid. The hydraulic fluid used to control the actuator member may also be used to control the locking mechanism. A hydraulic pump is operated using a computer, the computer having a processor and memory the processor for executing instructions on memory to control the pressure in the upper chamber and lower chamber.

In one embodiment, the actuator member controls a component of an aircraft. In one embodiment the component is landing gear.

According to another aspect, a method is provided for locking an actuator member in a selected position using a locking mechanism having a locking pin slideable within a housing between an extended position and a retracted position, the method comprising: adjusting the actuator member to the selected position; sliding the locking pin into the extended position; and receiving the locking pin in an insert in the actuator member for locking the actuator member in the selected position.

In one embodiment of the method, the locking pin is retracted from the extended position so that the locking pin is disengaged from the actuator member. The steps of sliding the locking pin into the extended position and the step of retracting the locking pin from the extended position are performed using a hydraulic pump. In some embodiments, the locking pin is biased in the extended position by using, for example, a mechanical spring. Further, the step of adjusting the actuator member may also be performed using hydraulic pressure acting on the actuator member.

In one embodiment of the method the hydraulic fluid used to control the hydraulic pressure acting on the actuator member may be the same as the hydraulic fluid used to drive the locking pin.

In another embodiment, the hydraulic pump is controlled using a computer having a processor for executing instructions stored on a memory.

In another embodiment, the actuator member controls a component of an aircraft. In one embodiment the component is landing gear.

In another embodiment, the steps of adjusting the actuator member may be controlled by a computer having a processor for executing instructions stored on a memory.

Actuators

An actuator is a mechanical device for moving or controlling components of a mechanism or system. Actuators receive energy and convert the energy into the mechanical motion of an actuator member. The actuator member can extend and retract within the actuator housing. Energy can be transmitted to the actuator member through the use of pressurized liquids (i.e. hydraulics) so that the actuator member moves in response to the pressure changes in the liquid. Alternatively, or additionally, the energy can be transmitted to the actuator member electrically or through other known means of transmitting energy. The energy transmission and the resulting movement of the mechanisms of the actuator (e.g. the movement of the actuator member) may be controlled remotely or locally and may be manually or automatically operated.

Actuators can be used to operate various components of larger systems. For example, an actuator can be used to operate (i.e. extend and/or retract) the landing gear or undercarriage of an aircraft. By way of further example, actuators may be used in a motor to transmit energy into movement of a device (e.g. a car, plane, drill, etc.).

Although the term "actuator" is used herein, it is recognized that other linearly movable parts could be substituted for the actuator and still utilize the locking mechanism disclosed herein.

Pistons

An actuator member can include a piston and a piston rod. The piston portion of the actuator member is typically a short, cylindrical metal component that separates the two parts of cylindrical actuator housing internally. The piston is usually machined with grooves to fit elastomeric or metal seals. These seals are often O-rings, U-cups or cast iron rings. They prevent the pressurized hydraulic oil from passing by the piston to the chamber on the opposite side. This difference in pressure between the two sides of the piston causes the cylinder to extend and retract. Piston seals vary in design and material according to the pressure and temperature requirements that the cylinder will see in service.

Actuator Assembly

Figure 2:
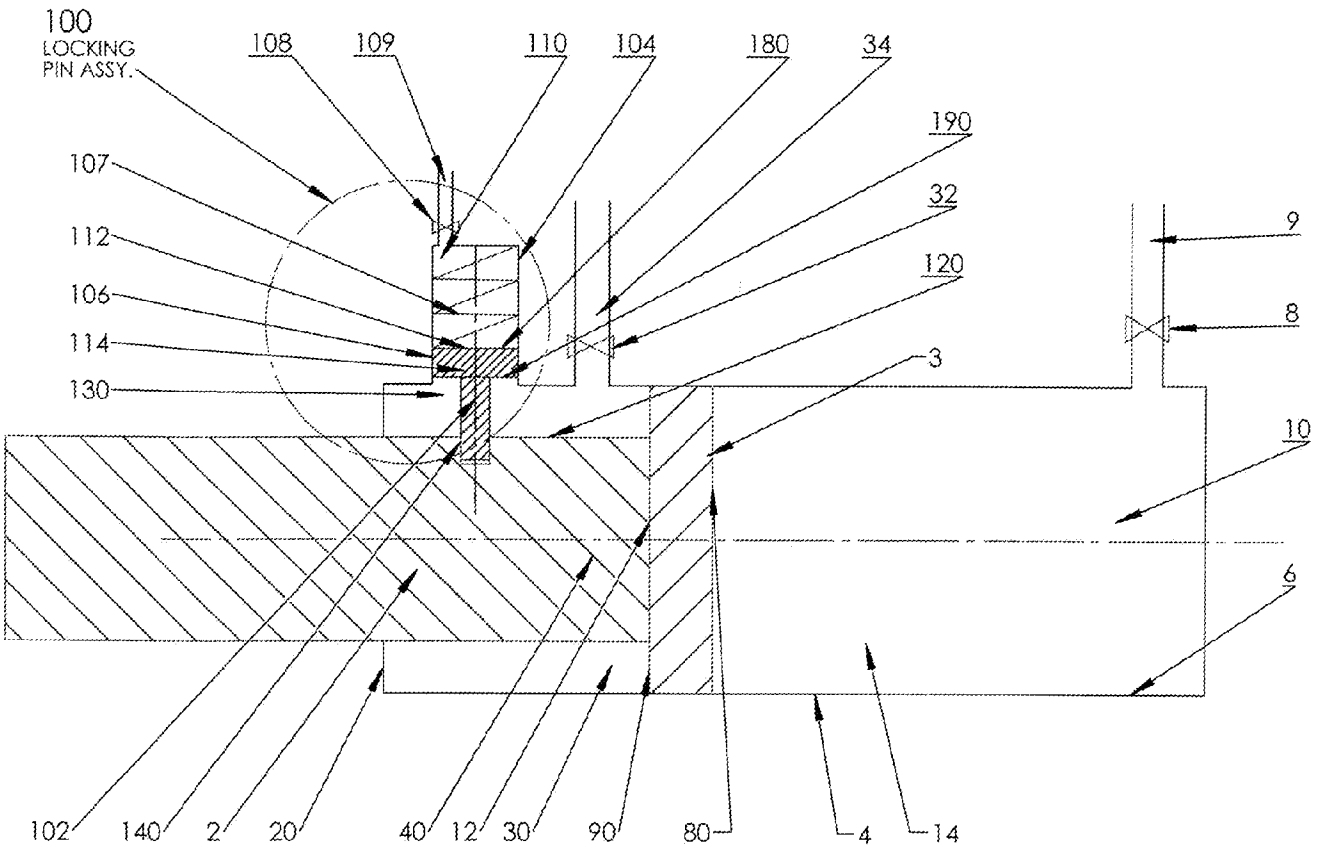
FIG. 2 is a schematic diagram of an actuator assembly with a locking pin assembly showing the actuator member in a second position.

Referring now to FIGS. 1 and 2, a schematic diagram is shown of an actuator assembly 11 having an actuator piston 2. The actuator piston 2, usually cylindrical in shape, moves within an interior 6 of an actuator cylinder housing 4 to extend and retract as illustrated by the different positions of the actuator member between FIGS. 1 and 2. It will be understood that the shape of interior 6 of the actuator cylinder housing 4 and the shape of the actuator piston 2 are usually complementary to allow for a mating engagement between the two and/or sliding engagement there between. The actuator piston 2 has a main body 40 that has a top end 12 and a bottom end 20. The actuator piston 2 also includes a piston head 14 with appropriate piston seals/rings circumnavigating its exterior. The piston rings/seals form a seal between the interior 6 and the actuator piston head 14, dividing the actuator cylinder housing 4 into two hydraulically independent halves.

An upper chamber 10 is defined within the interior 6 of the actuator cylinder housing 4 between the piston head top surface 80 of the actuator piston 2 and the closed end of the actuator cylinder housing 4. An upper valve 8 is fluidly connected to the chamber 10 to allow fluid and/or gas to enter and/or exit the chamber 10.

The valve 8 allows for fluid to enter and/or exit the chamber 10 (e.g. through a tube, pipe or other passage 9) in order to control the pressure of the fluid in the chamber 10. When the pressure in the chamber 10 is increased, a force is exerted on the piston head top surface 80 of the actuator piston 2 that causes the actuator piston 2 to extend outwardly from the cylinder housing 4. When the pressure in the chamber 10 decreases there is a decreased force acting on the piston head top surface 80 of the actuator piston 2 versus the bottom piston head surface 90 allowing the actuator piston 2 to retract within the actuator cylinder housing 4.

To cause the retraction of the actuator piston 2 an additional force can act on the piston head lower surface 90 that is higher then the force on the piston head top surface 80 of the actuator piston 2 to cause it to retract. This force can be a combination of hydraulic and mechanical means. For example, the actuator assembly 11 further defines a lower chamber 30 between the piston head lower surface 90 and the bottom end of the actuator cylinder housing 4 that connects to the end cap. The lower chamber 30 can include a valve 32 that allows for fluid to enter and/or exit the lower chamber 30 through passage 34. The actuator piston 2 can therefore be moved within the actuator cylinder housing 4 through the use of varying amounts and/or pressures of fluid flowing into and out of the two chambers 10 and 30. Hydraulic fluid can be fed into lower chamber 30 via lower valve 32 to act upon the lower surface 90 of the actuator piston head 14 forcing the actuator piston 2 to retract into the actuator cylinder housing 4.

Generally, the actuator piston 2 is biased towards retraction or extension (e.g. via gravity or other force applied to the actuator piston 2), and fluid, or an alternate resilient means, is fed into the chamber adjacent the actuator piston 2 bias position, to move the actuator piston 2 to the other non-biased position. Decreased flow of the fluid results in decreased pressure that allows the actuator piston 2 to return to its normally biased position. For example, the actuator piston 2 can be mechanically biased, using a spring or other resilient means, to cause the actuator piston to be biased to extend or retract with respect to the actuator cylinder housing 4.

The Locking Mechanism

FIGS. 1 and 2 further illustrate a locking pin assembly 100 having a locking pin 102. The locking pin assembly 100 can be used to lock the actuator piston 2 in a fixed position with respect to the locking pin 102 by interfering with the movement of the actuator piston 2.

The locking pin assembly 100 can be operated hydraulically similar to the actuator assembly 11. The locking pin 102, usually cylindrical in shape, moves within an interior 106 of a housing 104 between an extended position to interfere with the actuator piston 2 and a retracted position that allows movement of the actuator piston 2. The locking pin 102 can engage a recess 3 in the actuator piston 2 to facilitate locking the actuator piston 2 in a fixed position. The shape of interior 106 of the housing and the shape of the locking pin 102 are complementary to allow for a mating engagement between the two and/or sliding engagement.

The locking pin 102 has a main body 140 that has a top end 112 and a bottom end 120. The main body 140 can comprise a piston head as illustrated in FIGS. 1 through 7. The locking pin 102 may also include a piston rings/seals 114 circumnavigating its exterior. The piston rings/seals 114 form a seal between the interior 106 of the housing 104 and the bottom of the locking pin 102.

The locking pin assembly 100 can further include a mechanical bias 107 that forces the locking pin 102 towards the extended position to interfere with the actuator piston 2. The use of the mechanical bias 107 provides a lower cost locking pin assembly 100 because a secondary hydraulic system to extend the locking pin 102 to interfere with the actuator piston 2 is not required. When the locking pin assembly 100 is used in an aircraft landing gear, the mechanical bias 107 provides a safety feature to lock the actuator in an extended position (i.e. with the landing gear extended) that maintains locking operation in the event of a hydraulic failure. The mechanical bias 107 can also be used in combination with a hydraulic system to provide a redundant control that can operate the locking pin 102 if the hydraulic system fails. The mechanical bias 107 can comprise a spring (helical, leaf, gas or others spring types) or other applicable system.

Hydraulic force can be used to retract the locking pin 102 within the housing 104. Hydraulic fluid can act on the lower surface 190 of the piston head of the main body 140 of the locking pin 102 to cause the locking pin to move towards a retracted position to allow the actuator piston 2 to move freely. The housing 104 may further define a lower chamber 130 for receiving hydraulic fluid that can act the locking pin 102 the lower surface 190 of the main body 140 to cause the locking pin 102 to retract against the force of the mechanical bias 107. In some embodiments, the lower chamber 130 can be in fluid communication with the lower chamber 30 of the actuator cylinder housing 4 so that hydraulic pressure used to retract the actuator piston 2 can also force the locking pin 102 to retract to unlock the actuator piston 2. In other embodiments, the lower chamber 130 can be sealed from lower chamber 30 of the actuator cylinder housing 4 and include a separate valve (not shown) to control hydraulic pressure in the lower chamber 130 to independently operate the locking pin 102.

In some embodiments, the locking pin assembly 100 can use hydraulic force in conjunction with the mechanical bias 107 to extend the locking pin 102. The housing 104 can define an upper chamber 110 between the piston head top end 112 of the locking pin 102 and the interior 106 of the housing 104. An upper valve 108 can be used to control hydraulic pressure within the upper chamber 110. Hydraulic pressure can be increased in the upper chamber 110 to cause the locking pin 102 to extend from the housing 104 towards an extended position for interfering with the actuator piston 2.

When the pressure in the fluid chamber 110 is increased, a force is exerted on the top surface 180 of the locking pin 102, moving the locking pin 102 within the housing 104 and eventually extending the locking pin 102 outwardly from the housing 104 into the extended position. When the pressure in the fluid chamber 110 is decreased there is no longer a force acting on the top surface 180 of the locking pin 102 moving it out of the housing and it is therefore able to return to the retracted position if there is sufficient hydraulic pressure in the lower chamber 130 to counter act the force of the mechanical bias 107.

The locking mechanism will now be described in further detail with reference to FIGS. 3-7 in which the locking mechanism is indicated generally at numeral 300.

The locking mechanism 300 can be used for locking an actuator 350 in a selected position, also referred to as a locked position. More specifically, the locking mechanism 300 can lock an actuator piston 360 of an actuator 350 in an extended, retracted or other specific position. The locking mechanism 300 comprises a piston-style locking pin assembly 100.

Figure 3:
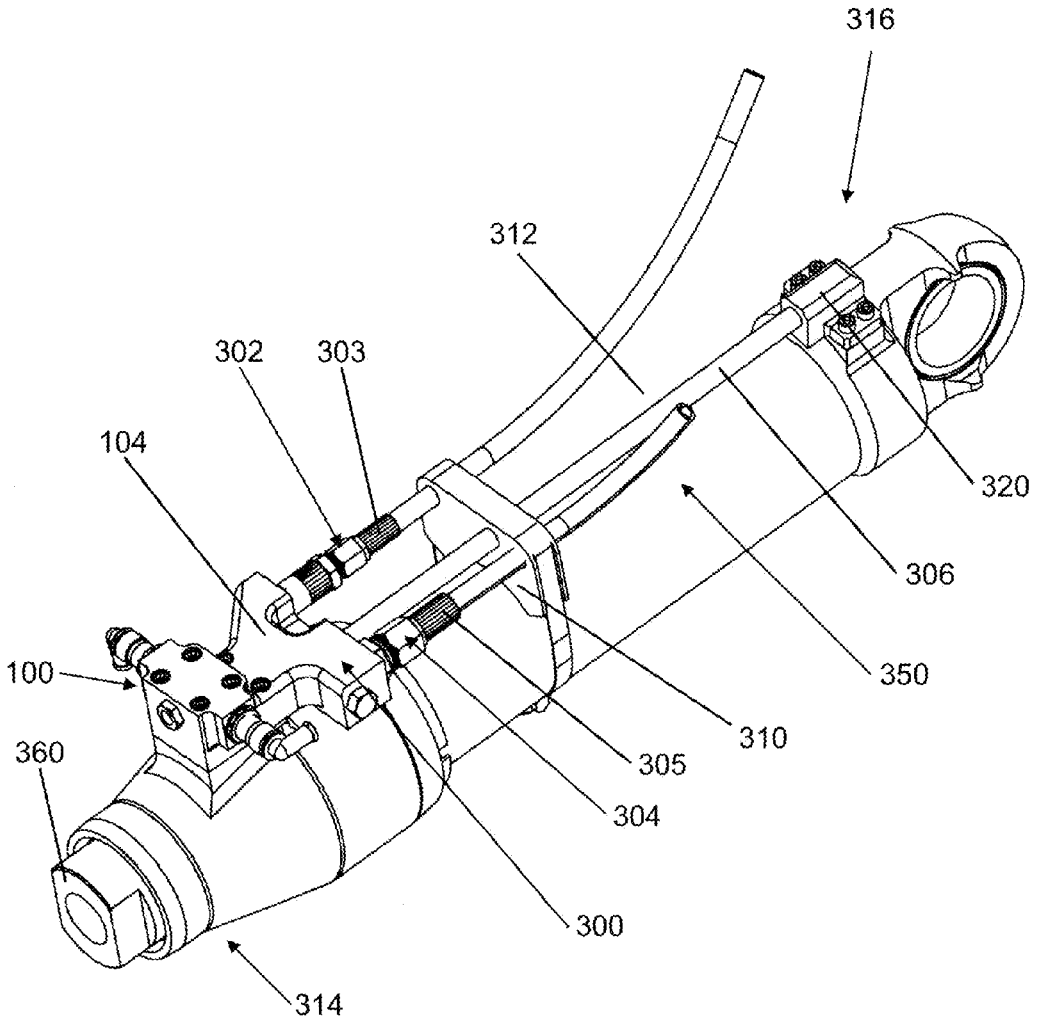
FIG. 3 is a perspective view of an embodiment of an actuator assembly and locking mechanism.
Figure 4:
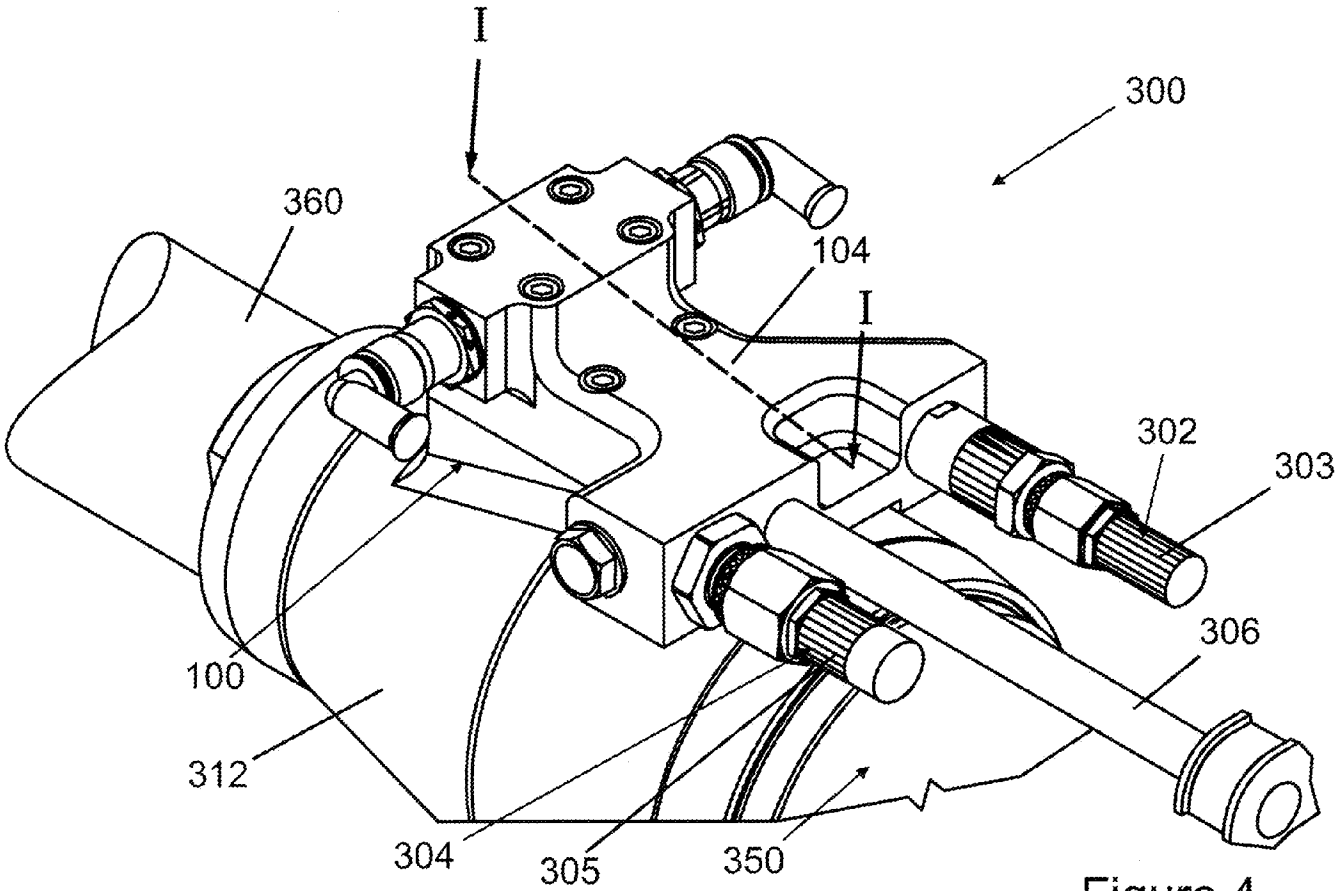
FIG. 4 is a sectional view of the locking mechanism of FIG. 3.

Referring to FIGS. 3 and 4, the locking mechanism 300 is shown attached to an actuator 350. The actuator 350 contains an actuator piston 360 that reciprocates within the actuator cylinder housing 312. The locking mechanism 300 is attached to the actuator cylinder housing 312 near the end cap 314 of the actuator cylinder housing 312. The locking mechanism 300 can be secured to the actuator cylinder housing 312 using bolts or other known attachment mechanisms. Alternatively, the locking mechanism 300 can be integrally formed with the actuator cylinder housing 312 or end cap 314 while maintaining the location of the locking mechanism 300 external relative to the internal components of the actuator 350. The locking mechanism 300 can include a separate cap that can be integrated with a filter that allows access and assembly of the locking mechanism 300.

The locking mechanism 300 is attached to the actuator cylinder housing 312 or end cap 314 at a position that allows the locking mechanism 300 to engage and lock the actuator piston 360, when the actuator piston 360 is positioned in the selected, or locked, position.

The actuator cylinder housing 312 has a rear end 316 opposite its end cap 314. The actuator cylinder housing 312 houses the actuator piston 360. The actuator piston 360 moves in a linear direction within the actuator cylinder housing 312 between an extended position and a retracted position.

Figure 5:
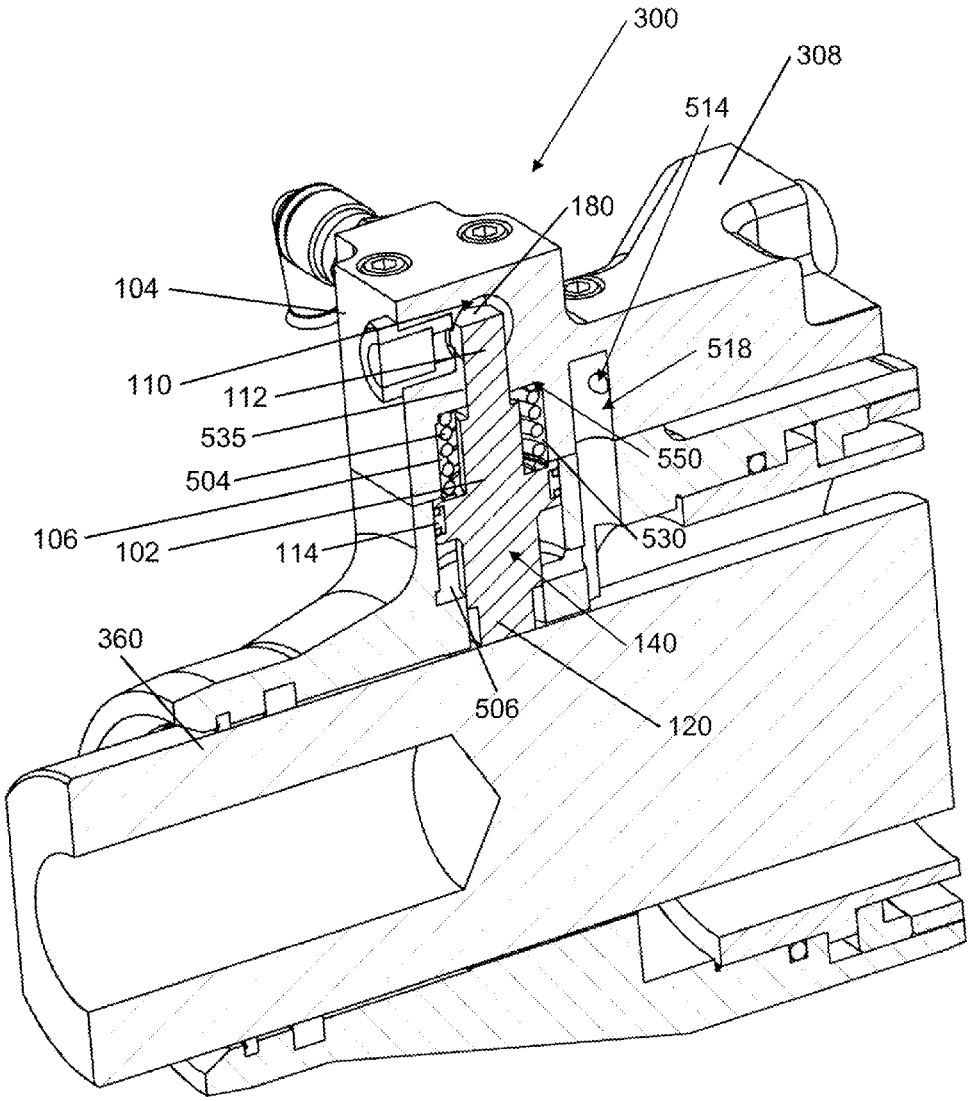
FIG. 5 is a cross-sectional view of the locking mechanism taken along line I-I of FIG. 4, showing the locking pin in the locked position.
Figure 6:
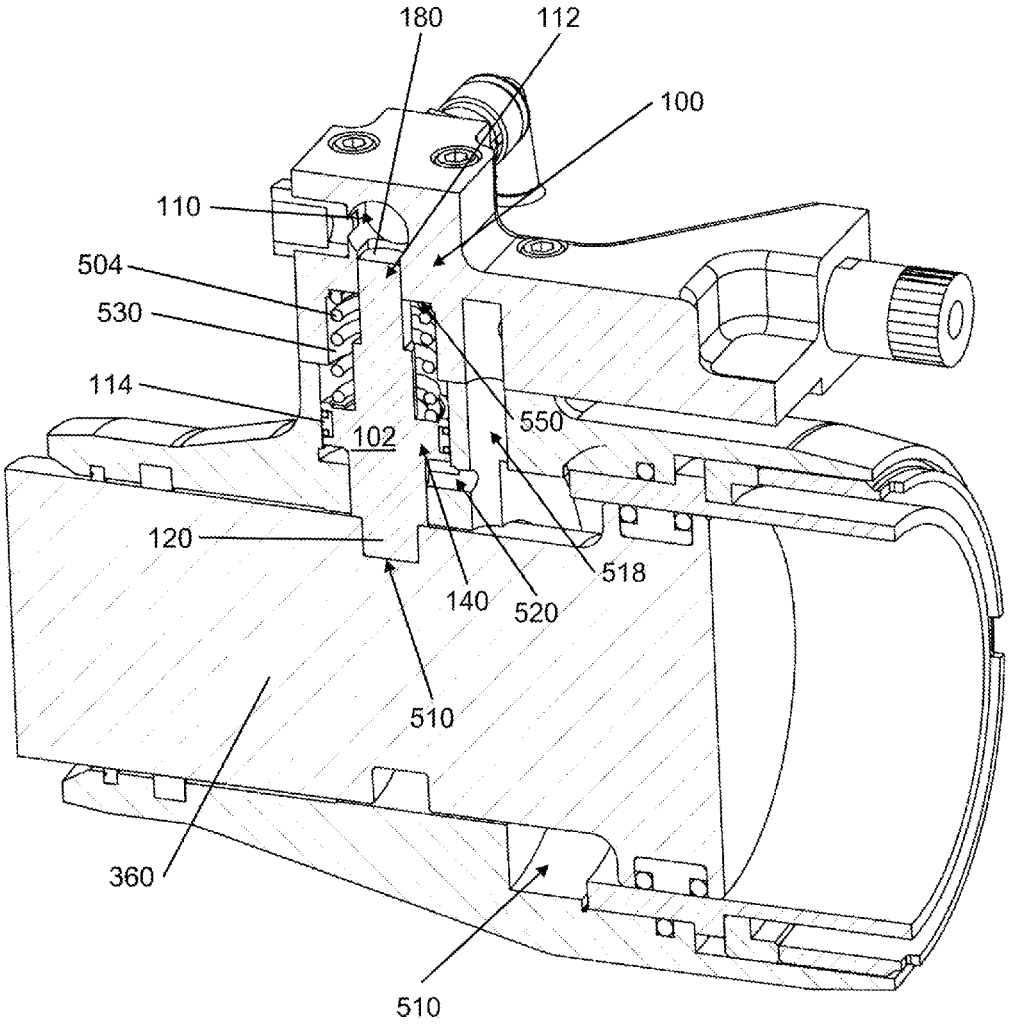
FIG. 6 is an alternate cross-sectional view of the locking mechanism taken along line I-I of FIG. 4; showing the locking pin in the locked position.

The locking mechanism 300, which can be seen clearly in FIGS. 5 and 6, comprises a piston-style locking pin assembly 100 including a locking pin 102 and a lock mechanism housing 104 defining an interior cavity 106 for receiving the locking pin 102. The locking pin 102 can also include a circumferential portion for engaging a larger surface area of the actuator piston 360. The locking pin 102 reciprocates within the cavity 106 in the housing 104 between an extended position, shown in FIGS. 5 and 6, and a retracted position, shown in FIG. 7. The sliding of the locking pin 102 in the housing 104 is controlled through a hydro-mechanical system. The hydraulic fluid can be controlled by a hydraulic pump or other controller that will be known to persons of ordinary skill in the art.

Figure 7:
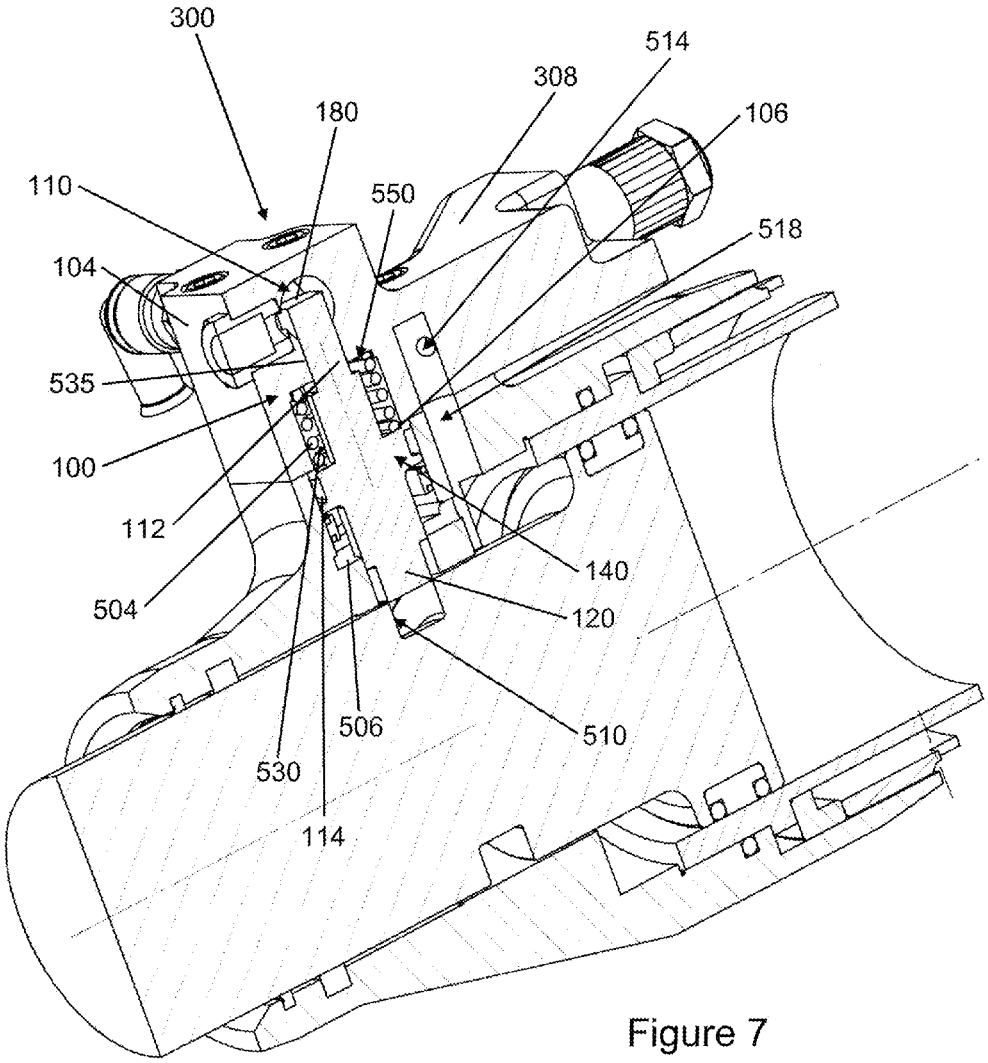
FIG. 7 is a cross-sectional view of the locking mechanism taken along line I-I of FIG. 4, showing the locking pin in the unlocked position.

The locking pin 102 shown in FIGS. 5-7 can slide between a retracted position and an extended position, or locked position. Preferably, the locking pin 102 extends in a radial direction relative to, or perpendicular to, the longitudinal axis of the actuator piston 360. In other embodiments, the locking pin 102 can extend perpendicular to the longitudinal axis of the actuator piston 360 but in a non-radial direction. As described generally above, the locking pin 102 has a top end 112, a body 140 and a bottom end 120. The bottom end 120 is configured to be received in a recess 510 in the actuator piston 360 in order to lock the actuator piston 360 in place so that the actuator piston 360 does not linearly move within the actuator cylinder housing 312. There may be multiple recesses 510 in the actuator piston 360, allowing for varying locked positions. Further, the recess 510 may circumnavigate the actuator piston 360 to allow the use of multiple locking pins to improve the locking mechanism safety design factor. Although the locking pin 102 is generally described as a pin, other embodiment of the locking pin 102 can include a collar portion that mates with the recess.

The locking pin 102 moves linearly within the housing 104 and is also sealed against the interior surface 530 of the cavity 106 in the housing 104. At least a portion of the body 140 of the locking pin 102 extends towards and engages with the interior surface 530 of the housing thereby defining a lower chamber 506 within the cavity 106 of the housing 104. The lower chamber 506 is fluidly sealed off from the remainder of the cavity 106 of the housing 104. The body 140 may further comprise piston rings 114, for example, which may circumnavigate the locking pin 102 about the body 140 of the locking pin 102. The piston rings 114 can hold a T-seal, or other appropriate type of seal, against the interior surface 530 of the cavity 106 of the housing 104 around the circumference of the locking pin 102 and may also serve to delineate or define the lower chamber 506.

The locking pin 102 is slideable within the housing 104 between a locked or extended position and an unlocked or retracted position. In the locked position the bottom end 120 of the locking pin 102 may be received by the actuator piston 360 when the actuator piston 360 is in a selected or specific position. For example, the bottom end 120 is configured to fit into a recess 510 in the actuator piston 360 when the recess 510 is aligned with the bottom end 120 of the locking pin 102 so that, when the locking pin 102 extends from the housing 104, the bottom end 120 of the locking pin 102 is received in the recess 510 of the actuator piston 360 thereby locking the actuator piston 360 in the extended position.

In the retracted position, the locking pin 102 is received within the housing 104. In one embodiment, the locking pin 102 is received substantially within the housing 104. It will be further understood that in the retracted position, the locking pin 102 is positioned to allow for movement of the actuator piston 360 within the actuator cylinder housing 312.

In one embodiment, the locking mechanism 300 is hydraulically operated. For example, the controller can include a hydraulic pump and controlled valves that are used to increase or decrease the pressure of the hydraulic fluid within at least a portion of the housing 104. In the embodiment depicted, a pipe 306 extends from the housing 104 towards the rear end 316 of the actuator cylinder housing 312 and provides a passageway for fluid flowing to and/or from the locking mechanism 300, seen in FIGS. 3 and 4 to the rear side of the actuator that extends the actuator when filling with hydraulic fluid. The pipe 306 is secured near the rear end 316 of the housing by a clamp 320. The pipe 306 is also held in place near the actuator cylinder housing 312 by a support bracket 310. Other mechanisms for securing the pipe 306 to the actuator cylinder housing 312 that are familiar to skilled persons may be used. The pipe 306 provides a fluid passage for providing (or removing) fluid or gases to (or from) the cylinder housing end 316, as described in more detail below.

Upper valve 302 and lower valve 304 can control the fluid passage into the upper chamber 110 (if applicable) and lower chamber 506, respectively, thereby controlling the pressure exerted on the locking pin 102. The upper and lower valves may thus together comprise the controller that controls the movement of the locking pin 102 within the housing 104.

The pressure exerted on the locking pin 102 in the upper chamber 110 is exerted by a spring 504 onto the locking pin 102. This pressure forces the locking pin 102 towards the actuator piston 360. In some embodiments, pressure can also be exerted by hydraulic pressure in the upper chamber 110. The hydraulic pressure can also be exerted on the locking pin 102 in the lower chamber 506 onto the lower surface 190 of the piston head of the main body 140.

If the pressure exerted by the spring 504 is greater than the pressure in the lower chamber 506, the locking pin 102 will travel towards the actuator piston 360 into the extended or locked position. Use of the mechanical bias of the spring provides a safety feature that allows the actuator piston 360 to maintain the lock position in the event of lost hydraulic pressure. Hydraulic pressure in the upper chamber 110 can also be used to move the locking pin 102 towards the locked position. If the recess 510 is positioned to receive the locking pin 102 (i.e. the recess 510 is aligned with the locking pin 102), the bottom end 120 of the locking pin 102 may be received in the recess 510 of the actuator piston 360 thereby locking the actuator piston 360 in the selected position. This will position the locking pin 102 in the locked position. Additionally, there may be an extension or member on the locking pin 102 which will abut the housing 104 preventing the locking pin 102 from travelling too far out of the housing 104.

If the pressure in the lower chamber 506 is greater than the pressure exerted by the spring 504 (or in other embodiments, the spring in combination with the hydraulic pressure in the upper chamber), the locking pin 102 may be forced to travel away from the actuator member 360 thereby releasing the bottom end 120 of the locking pin 102 from the recess 510 of the actuator member 360. This will move the locking pin 102 to the unlocked or retracted position. When the bottom end 120 of the locking pin 102 is released from the recess 510 of the actuator member 360, the actuator member 360 will not be restricted by the locking pin 102 from moving laterally with respect to the longitudinal direction of the locking pin 102.

As shown in FIGS. 5 and 6, a spring 504 is contained in the interior of the housing 104. The spring 504 extends between an upper surface 550 of the cavity 106 in the housing 104 and the main body 140 of the locking pin 102. The spring 504 provides a mechanical bias to move the locking pin 102 towards the extended position. The mechanical bias can be provided using alternative spring types (e.g. coil springs or other compression springs) or a resilient material as is known to a person skilled in the art.

The locking mechanism 300 may be made out of hard metal, for example. Alternatively, depending on the application, the locking mechanism 300 may be made out of other resilient materials.

The actuator 350 can be controlled using hydraulics (e.g. using the pressure provided by the introduction of hydraulic fluid). The control of the locking mechanism 300 through the fluid pressure in the upper chamber 110 and the lower chamber 506 can be performed using the same hydraulic fluid that is used to control the actuator 350. The lower chamber 506 can be in fluid communication with the lower interior actuator chamber so that hydraulic fluid introduced in opening 514 flows through channel 518 and passage 520 into lower chamber 506 to move the locking pin to the unlocked or retracted position, and the hydraulic fluid also exerts pressure below the seal of the actuator piston 360 to retract the actuator piston 360. Hydraulic pressure introduced to retract the actuator piston 360 thus also unlocks locking mechanism 300.

Similarly, the upper interior actuator chamber can be in fluid communication with the upper chamber 110 so that hydraulic pressure used to move the actuator piston can also be used to exert a locking force on the locking pin 102 to move the locking towards the locked position.

Further, the pressure in the upper chamber 110 and in the lower chamber 506 can be controlled using a computer. The computer having a processor and memory. The processor can execute instructions stored on memory in order to control the pressure in the upper chamber 110 and lower chamber 506. For example, the actuator 350 may be used to operate an aerospace component, such as an undercarriage or landing gear, and the control of the actuator 350 (including locking the actuator 350 in place using the locking mechanism 300) may be performed on a remote console in the cockpit. The computer may comprise the remote console.

Operation

In operation, the actuator piston 360 can move to a selected position while the locking pin 102, of the locking mechanism 100, is in the retracted position. In the selected position, the recess 510 of the actuator piston 360 is aligned under or with the longitudinal direction of the locking pin 102. For example, there may be an electronic or other type of motor operating to displace the actuator piston 360. Further, the displacement of the actuator piston 360 may be operated manually or through an automated system or process.

Figure 8:
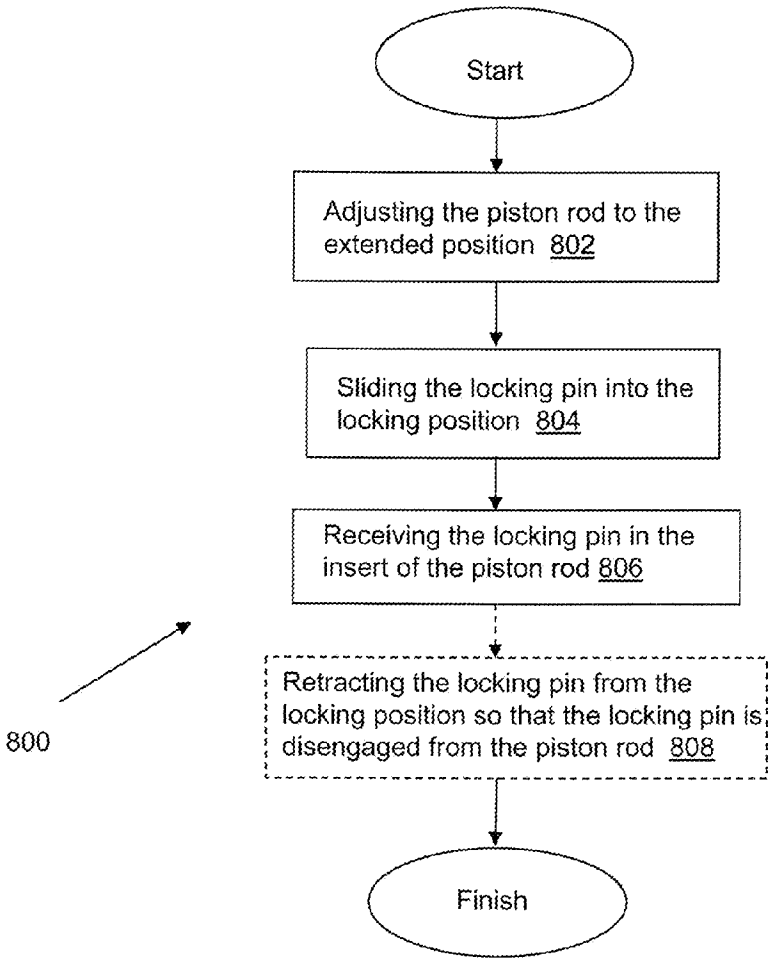
FIG. 8 illustrates a method of operating embodiments of the locking mechanism to lock an actuator in a selected position.

FIG. 8 is a flow chart showing one embodiment of the method 800 for locking an actuator piston 360 of an actuator 350 in a selected position.

At step 802 the actuator piston 360 moves to the selected position. For example, the actuator piston 360 can be moved into its extended position either manually or automatically. The recess 510 of the actuator piston 360 is thereby positioned in-line with the bottom end 120 of the locking pin 102 so as to receive the locking pin 102 therein when the locking pin 102 is in its locked or extended position (as shown in FIGS. 5-7, for example). There can be multiple locking pins 102 and multiple recesses 510 in the actuator piston 360 so that the actuator piston 360 can be adjusted or moved to one of a selection of positions and locked in that selected position with one or more pins 102 (i.e. with one of the recesses 510 receiving the locking pin 102). The adjustment of the actuator piston 360 can be performed using hydraulic pressure (i.e. hydraulic fluid) acting on the actuator 350 or actuator piston 360. Further, the hydraulic fluid used to control the hydraulic pressure acting on the actuator piston 360 or actuator 350 can be the same as the hydraulic fluid used to operate or control the opening of the locking mechanism 300 (i.e. the hydraulic fluid used to drive the locking pin 102).

At step 804, the locking pin 102 is moved into the extended position, i.e. the locked position, shown in FIGS. 5 and 6. The pressure exerted by the spring 504 is higher relative to the pressure exerted by the fluid in the lower chamber 506 of the housing 104, and the biasing action of the spring 504, drives the locking pin 102 towards the actuator piston 360. This occurs by releasing hydraulic fluid from the lower chamber 506. In some embodiments, the hydraulic pressure in the upper chamber 110 of the housing 104 can be increased relative to the pressure in the fluid in the lower chamber 506 of the housing 104, and this pressure along with the biasing action of the spring 504, drives the locking pin 102 towards the actuator piston 360.

It is recognized that other types of controllers can be used to control the sliding of the locking pin 102 within the housing 104.

At step 806, the locking pin 102 is received in the recess 510 of the actuator piston 360 for locking the actuator piston 360 in the selected position. When the pressure caused by spring 504 is greater than the pressure in the lower chamber 506, the locking pin 102 will slide in the direction of the lower chamber 506. The locking pin 102 then extends out of the housing 104. When the locking pin 102 extends out of the housing 104, and when a recess 510 of the actuator piston 360 is positioned underneath the locking pin 102, the bottom end 120 of the locking pin 102 is received in the recess 510. The positioning of the bottom end 120 of the piston in the recess 510 restricts or prevents the actuator piston 360 from moving in a direction lateral to the locking pin 102. The spring 504 assists by maintaining the locking pin 102 in its extended or locked position (i.e. locking the actuator piston 360 in the selected position).

At step 808, the locking pin 102 is optionally retracted from its locked position so that the locking pin 102 is disengaged from the actuator piston 360 and so that the locking pin 102 slides towards the upper chamber 110, as shown in FIG. 7. The actuator piston 360 is no longer restricted from movement relative to the locking pin 102. The locking pin 102 can be moved to the retracted position by increasing the pressure in the lower chamber 506 until it can overcome the biasing action of the spring 504.

The upper and lower valves used to increase or decrease pressure in the upper and lower chambers can be operated manually or by an automated system. For example, the valves can be connected to a main control centre (e.g. a computer having a memory storing instructions and a processor for executing those instructions).

One or more currently preferred embodiments have been described by way of example. It will be apparent to persons skilled in the art that a number of variations and modifications can be made without departing from the scope of the invention as defined in the claims.

We claim:

1. A locking hydraulic actuator for locking an actuator piston in an extended position, the locking hydraulic actuator comprising:

an actuator cylinder housing for receiving the actuator piston therein, the actuator cylinder housing defining an upper interior actuator chamber for receiving hydraulic fluid to exert an extension force on the actuator piston, the actuator cylinder housing defining a lower interior actuator chamber for receiving hydraulic fluid to exert a retraction force on the actuator piston;

a lock mechanism housing defining an interior cavity extending into the lower interior actuator chamber of the actuator housing; and a locking pin in sealed engagement within the interior cavity of the lock mechanism housing, the locking pin mechanically biased towards a locking position wherein the locking pin extends into the lower interior actuator chamber to lockingly engage the actuator piston, the lower interior actuator chamber configured to receive hydraulic fluid when the locking pin is lockingly engaged with the actuator piston.

2. The locking hydraulic actuator of claim 1, wherein the interior cavity defines a lower chamber below the sealed engagement of the locking pin, the lower chamber configured to receive hydraulic fluid to move the locking pin to an unlocked position.

3. The locking hydraulic actuator of claim 2, wherein the interior cavity defines an upper chamber above the sealed engagement of the locking pin, and the upper chamber is configured to receive hydraulic fluid to move the locking pin to the locking position.

4. The locking hydraulic actuator of claim 3, wherein the upper interior actuator chamber is in fluid communication with the upper chamber of the interior cavity such that hydraulic fluid received in the upper interior actuator chamber exerts a locking force on the locking pin to move the locking pin to the locked position.

5. The locking hydraulic actuator of claim 3, wherein the source of hydraulic fluid is operated using a computer, the computer having a processor and non-transitory computer readable medium, the processor for executing instructions stored in the non-transitory computer readable medium to control hydraulic fluid pressure in the upper chamber and lower chamber.

6. The locking hydraulic actuator of claim 2, wherein the lower interior actuator chamber is in fluid communication with the lower chamber of the interior cavity such that hydraulic fluid received in the lower interior actuator chamber exerts an unlocking force on the locking pin to move the locking pin towards the unlocked position.

7. The locking hydraulic actuator of claim 1, wherein the locking pin is mechanically biased towards the locking position by a spring.

8. The locking hydraulic actuator of claim 1, wherein the actuator piston has a recess defined therein for receiving the locking pin when the actuator piston is in the extended position.

9. The locking hydraulic actuator of claim 1, wherein the actuator piston has a plurality of recesses defined therein for receiving the locking pin when the actuator piston is in any one of a plurality of extended positions.

10. The locking hydraulic actuator of claim 1, wherein the actuator piston controls aircraft landing gear.

11. A method for unlocking an actuator piston in an actuator assembly from a selected position using a locking mechanism located externally from the actuator assembly and having a locking pin slideable within a housing between an extended position and a retracted position, the method comprising:

adjusting the actuator piston to the selected position;

sliding the locking pin into the extended position;

receiving the locking pin in a recess in the actuator piston thereby locking the actuator piston in the selected position; and retracting the locking pin from the selected position by hydraulic pressure simultaneously exerted against the locking pin and the actuator piston, thereby disengaging in from the actuator piston.

12. The method of claim 11, wherein the step of sliding the locking pin into the extended position and the step of retracting the locking pin from the selected position are performed using a hydraulic pump.

13. The method of claim 11, wherein the step of adjusting the actuator piston is performed using hydraulic pressure acting on the actuator piston and the same hydraulic fluid used to drive the locking pin.

14. The method of claim 11, wherein the actuator piston controls an aircraft landing gear.

* * * * *